US011447843B2

(12) United States Patent
Park et al.

(10) Patent No.: US 11,447,843 B2
(45) Date of Patent: Sep. 20, 2022

(54) RESETTABLE ALLOYS AND MANUFACTURING METHOD FOR THE SAME

(71) Applicant: Seoul National University R&DB Foundation, Seoul (KR)

(72) Inventors: Eun Soo Park, Seoul (KR); Kook Noh Yoon, Seoul (KR); Min Seok Kim, Seoul (KR); Sang Jun Kim, Seoul (KR); Jeong Won Yeh, Seoul (KR)

(73) Assignee: SEOUL NATIONAL UNIVERSITY R&DB FOUNDATION, Seoul (KR)

( * ) Notice: Subject to any disclaimer, the term of this patent is extended or adjusted under 35 U.S.C. 154(b) by 31 days.

(21) Appl. No.: 16/996,773

(22) Filed: Aug. 18, 2020

(65) Prior Publication Data

US 2021/0147954 A1 May 20, 2021

(30) Foreign Application Priority Data

Nov. 19, 2019 (KR) ..... 10-2019-0148600

(51) Int. Cl.

| | |
|---|---|
| ***C22C 38/38*** | (2006.01) |
| ***C21D 9/00*** | (2006.01) |
| ***C22C 38/30*** | (2006.01) |
| ***C21D 8/02*** | (2006.01) |
| ***C22C 38/22*** | (2006.01) |
| ***C22C 38/24*** | (2006.01) |
| ***C22C 38/26*** | (2006.01) |

(52) U.S. Cl.

CPC ..... *C21D 9/0062* (2013.01); *C21D 8/0273* (2013.01); *C22C 38/22* (2013.01); *C22C 38/24* (2013.01); *C22C 38/26* (2013.01); *C22C 38/30* (2013.01); *C22C 38/38* (2013.01); *C21D 2211/001* (2013.01); *C21D 2211/008* (2013.01)

(58) Field of Classification Search

CPC ..... C22C 38/38

See application file for complete search history.

(56) References Cited

U.S. PATENT DOCUMENTS

2004/0149362 A1* 8/2004 Kusinski ..... C21D 7/02 148/650

FOREIGN PATENT DOCUMENTS

CN 105925896 A * 9/2016 ..... C21D 8/0226

OTHER PUBLICATIONS

CA Schuh et al. "Estimation of grain boundary segregation enthalpy and its role in stable nanocrystalline alloy design", Journal of Materials Research, vol. 28, Issue 16, 2013, pp. 2154-2163.

* cited by examiner

*Primary Examiner* — Jophy S. Koshy
(74) *Attorney, Agent, or Firm* — Lex IP Meister, PLLC

(57) ABSTRACT

A resettable alloy having a resetting mechanism introduced thereinto through simple resetting treatment, thereby prolonging the lifespan of materials, and a manufacturing method for the same are provided. The resettable alloy comprises a body-centered tetragonal(BCT)-face-centered cubic(FCC) dual structure comprising: BCT martensite phase matrix; and FCC austenite phase present within the matrix, wherein the FCC phase is formed by selective segregation of component elements and can be repetitively reset through metastable reversible phase transformation.

2 Claims, 9 Drawing Sheets

*FIG.2*

| $\Delta H_{segregation}$ (J/mol) | | Solvent | | | | |
|---|---|---|---|---|---|---|
| | | Cr | Mn | Fe | Co | Ni |
| Solute | Cr | - | -11652 | 3737 | 2720 | -728 |
| | Mn | 15095 | - | 16605 | 13781 | 10005 |
| | Fe | -1676 | -16222 | - | -527 | -4765 |
| | Co | -1485 | -18154 | 243 | - | -2473 |
| | Ni | -223 | -17223 | 2124 | 2237 | - |

RESETTABLE ALLOYS AND MANUFACTURING METHOD FOR THE SAME

CROSS REFERENCE TO RELATED APPLICATION

This application claims priority from Korean Patent Application No. 10-2019-0148600, filed on Nov. 19, 2019, which is hereby incorporated by reference for all purposes as if fully set forth herein.

BACKGROUND OF THE INVENTION

1. Field of the invention

The present disclosure relates to an alloy showing resettability and a manufacturing method for the same and, more particularly, to a resettable alloy having a novel resetting mechanism introduced thereinto, and a manufacturing method for the same.

2. Description of the Prior Art

With the rapid advance of scientific technology, modes of transport have been increased in both speed and size. However, such increases are also accompanied by increased in the severity of accidents. Accordingly, increasing attention is paid to the guarantee of safety by prolonging the lifespan of the materials. In this context, studies have been conducted into mechanisms, such as self-healing, stress-relief heat treatment, and so on, for prolonging the life of materials.

When cracks propagate in a matrix, a self-healing mechanism operates as materials responsible for closing the cracks diffuse through the matrix. However, a self-healing mechanism is highly unlikely to work in metals because of the extremely low diffusion coefficients thereof.

Meanwhile, stress relief heat treatment is a mechanism in which an external energy is applied to a material to reduce residual stresses whereby the lifespan of the material is increased. However, a stress relief heat treatment incurs phenomena such as grain growth, defect annihilation, etc. as well as inducing the reduction of residual stresses, thereby rapidly decreasing the strength of the material.

PRIOR ART

Non-Patent Document

[Literature 1] Journal of Materials Research, Volume 28, Issue 16, 2013. "Estimation of grain boundary segregation enthalpy and its role in stable nanocrystalline alloy design" C A Schuh et al., pp. 2154-2163

SUMMARY OF THE INVENTION

In this background, an aspect of the present disclosure is to provide a resettable alloy having a resetting mechanism, which is a novel mechanism capable of prolonging the lifespan of a material through simple resetting treatment (hereinafter referred to as "R-treatment) and overcoming the limits of self-healing and stress relief heat treatment mechanisms representative of the mechanisms that can heal damages of materials prior to macro fracture, and a manufacturing method for the same.

Particularly, the present disclosure is to design a resettable material that can prevent grain growth, which is regarded as the limit of conventional stress relief heat treatment, in consideration of grain boundary segregation enthalpy quantitatively indicative of grain boundary segregation tendency within materials upon composition design in order to precisely control local microstructures.

In accordance with an aspect thereof, the present disclosure provides a resettable alloy comprising the following composition:

body-centered tetragonal(BCT)-face-centered cubic (FCC) dual structure including:

body-centered tetragonal(BCT) martensite phase matrix; and face-centered cubic(FCC) austenite phase present within the matrix, wherein the FCC phase is formed by selective segregation of component elements and can be reset through metastable reversible phase transformation.

In this regard, the austenite phase may be particularly formed at the subgrain boundary of lath martensite.

The austenite phase particularly may have a size of 10 μm or less.

In addition, the martensite phase matrix may contain a residual austenite phase of 50% by volume therein.

Meanwhile, the resettable alloy may consist of the following composition:

$Fe_{100-a-b-c}Mn_aCr_bC_c$ ($3 \le a \le 15$, $0 < b \le 11.87$, and $0 < c \le 2.01$ wt %)

Moreover, the resettable alloy may particularly further comprise at least one selected from V, Nb, Mo, Ta, and W in an amount of up to 3 wt. % based on the total weight thereof in order to increase the strength.

The present disclosure was developed by highly controlling microstructures so as to induce a metastable reversible phase transformation behavior in a region where a specific element is segregated by selective segregation. As used herein, the term "resettable alloy" refers to an alloy wherein the initial microstructure and properties thereof can be recovered when specific resetting treatment is applied thereto after same has undergone deformation.

The resettable alloy of the present disclosure is based on a common alloy containing iron(Fe) as a main component in combination with alloying elements including manganese (Mn) for exhibiting a selective segregation behavior and stress-induced transformation, chromium(Cr) for increasing oxidation resistance, and other elements.

The resetting mechanism of the present invention has resetting upon external energy application in common with stress relief heat treatment, but is different from stress relief heat treatment in that the latter is simply directed to a relief of residual stress whereas the former is designed to recover the pre-deformation initial microstructure by highly controlling microstructures so as to exhibit a metastable reversible phase transformation behavior in a region where a specific element is segregated. Accordingly, when the resetting mechanism is applied thereto, the material can repetitively be recovered to the initial performance and can be provided with a prolonged lifespan.

In accordance with another aspect thereof, the present disclosure provides a method for manufacturing a resettable alloy, the resettable alloy including a body-centered tetragonal(BCT)face-centered cubic(FCC) dual structure comprising:

BCT martensite phase matrix; and

FCC austenite phase present within the matrix, the method comprising the following steps:

preparing and melting alloy elements to which segregation engineering is applicable, to afford an alloy;

applying a two-step heat treatment to the alloy to form a BCT-FCC dual phase microstructure that is able to undergo metastable reversible phase transformation; and optimizing resettability in the alloy through resetting treatment.

Preferably, the alloy may have the composition $Fe_{100-a-b-c}Mn_aCr_bC_c$ ($3 \le a \le 15$, $0 \le b \le 11.87$, and $0 \le c \le 2.01$ wt. %).

The two-step heat treatment comprises homogenization treatment(hereinafter referred to as "H-treatment") as the first step; and preferential site segregation treatment(hereinafter referred to as "P-treatment") as the second step.

The two-step heat treatment including H-treatment and P-treatment may be carried out to afford an alloy having a microstructure suitable for exhibiting a resetting property.

The second step P-treatment may be preferably conducted in the following temperature range between Tmin and Tmax, both inclusive, depending on the composition(wt. %) of manganese(Mn):

$$T\max(^\circ\,C.) = -18 \cdot wt\,\%(Mn) + 820$$

$$T\min(^\circ\,C.) = -18 \cdot wt\,\%(Mn) + 640$$

In the present disclosure, 3d transition elements and Mn, which is known to be the highest in grain boundary segregation tendency, are added so as to control local phase stability of grain boundary. In other words, an FCC phase that can undergo metastable reversible phase transformation is controlled to be partially precipitated at the grain boundary through the two-step heat treatment.

Process conditions for the two-step heat treatment are designed by fine calculation using Thermo-Calc software TCFE 8 database. The FCC phase precipitated through the two-step heat treatment is transformed into a martensite phase through stress-induced transformation when the material is used or deformed. Thereafter, a design is made to induce reverse martensitic transformation to an austenite phase upon R-treatment, thereby exhibiting a resetting property.

As described hitherto, the resettable alloy of the present disclosure can recover the initial properties thereof through the resetting treatment even when local deformation is generated during the use thereof, thereby prolonging the lifespan of materials.

Particularly, the resettable alloy of the present disclosure is designed to have a BCT-FCC laminate dual structure introduced thereinto through H-treatment followed by P-treatment and thus to allow reversible phase transformation between FCC and BCT phases at BCT phase grain boundaries while achieving grain refinement, whereby the materials can be repetitively reset into the initial microstructures thereof to simultaneously recover strength properties and prolong the lifespan thereof.

BRIEF DESCRIPTION OF THE DRAWINGS

The above and other aspects, features and advantages of the present disclosure will be more apparent from the following detailed description taken in conjunction with the accompanying drawings, in which:

FIG. 2 is a view showing segregation enthalpy relationship of the 3d transition metals Cr, Mn, Fe, Co, and Ni serving as components of face-centered cubic(FCC) alloys in a single solid solution state;

DETAILED DESCRIPTION OF THE EXEMPLARY EMBODIMENTS

Figure 1:
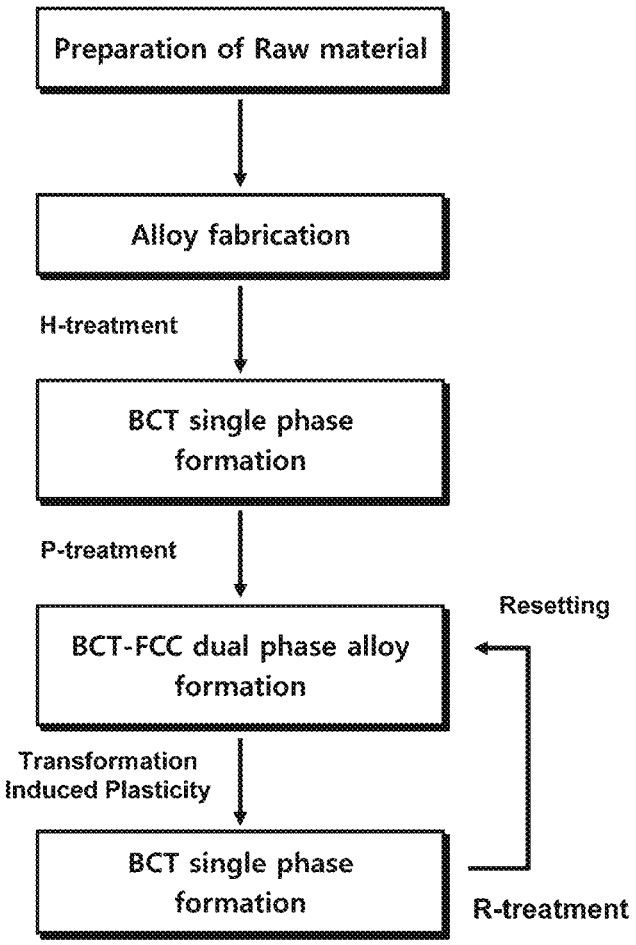
FIG. 1 is a flow chart showing individual process steps for manufacturing a resettable alloy of the present disclosure.

Hereinafter, exemplary embodiments of the present invention will be described with reference to the accompanying drawings. In the following description, the same elements will be designated by the same reference numerals although they are shown in different drawings.

The alloy of the present disclosure is fabricated by (1) preparing alloy elements to which segregation engineering can be made; and (2) applying a two-step heat treatment to the alloy elements to form a BCT-FCC dual phase microstructure that is easily resettable.

The two-step heat treatment includes a first and a second step: the first step is homogenization treatment for forming BCT martensite single phase in the alloy; and the second step corresponds to a selective segregation process in which Mn is subjected to selective grain boundary segregation in the martensite single phase, followed by quenching to selectively precipitate an austenite phase as a secondary phase at the grain boundary so as to form a laminate composite structure.

The alloy thus obtained is characterized by iterative reuse, wherein when deformation occurs, the applied stress induces the austenite phase precipitated as the secondary phase to undergo metastable reversible phase transformation directing to phase transformation into a martensite phase which is then recovered to the initial microstructure through resetting treatment. This procedure is depicted in FIG. 1.

Below, a detailed description will be given of the structure and fabrication method of the resettable alloy according to the present disclosure.

Selection of Group of Segregation Engineering-Applicable Elements The resettable alloy of the present disclosure takes advantage of metastable reversible phase transformation between body-centered tetragonal(BCT) martensite phase and face-centered cubic(FCC) austenite phase.

In this regard, a perfect resettable alloy may be realized under the following conditions: (1) an austenite phase with a size of 10 pm or less is advantageously formed uniformly across the alloy so that homogeneous deformation can occur in the entire region of the alloy under a stress; (2) fulling phase resetting into the initial BCT-FCC dual phase alloy after resetting treatment; and (3) recovery of microstructures such as grain size, etc. Therefore, an alloy design approach therefor will be delineated in detail, below.

For the fine formation of an austenite phase, which serves as a secondary phase, by preferential site segregation treatment, nucleation, which is relatively easy to achieve, is crucial before phase growth.

Meanwhile, the austenite phase may be formed at the lath-shape subgrain boundary of high energy in the martensitic microstructure and may have a size of up to 10 μm.

It is widely known that an iron(Fe)-based alloy has a low stacking fault energy when alloyed with manganese(Mn). Accordingly, the resulting alloy can easily exhibit martensite-austenite reversible phase transformation. For this reason, selection is made of Fe and Mn as main elements in the present disclosure.

Furthermore, the resettable alloy of the present disclosure might be prone to oxidization because the alloy undergoes repetitive resetting treatment(R-treatment) for structural recovery as well as the two-step heat treatment including H-treatment and P-treatment in that order. In order to solve the problem, chromium(Cr) is selected as an additional alloying element. Cr, which is easily solid soluble in iron, can act as an alloying element that forms a dense oxide texture at high temperatures, thus making a great contribution to increasing oxidation resistance.

Moreover, as is understood from the data of the table in FIG. 2, chromium is advantageous for forming a microstructure suitable for the resettable alloy in light of the fact that chromium has a positive(+) segregation enthalpy as a solute in iron alloys.

Figure 3:
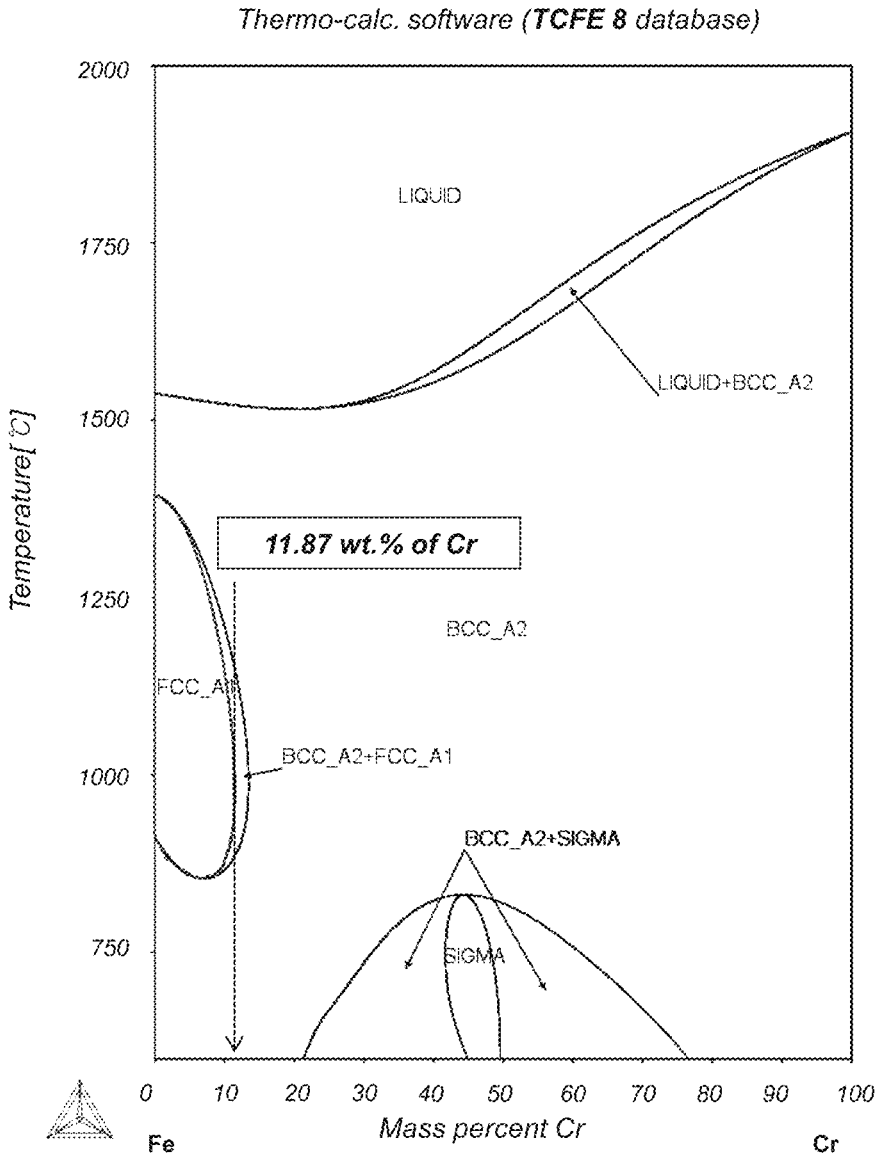
FIG. 3 is a Fe-Cr binary phase diagram showing maximum solubility of Cr soluble in face-centered cubic(FCC) Fe.

FIG. 3 is a binary phase diagram of the main elements Fe and Cr of the present disclosure as calculated with TCFE 8 database, which is an iron-based thermodynamic database from Thermo-Calc thermodynamic simulation. Unless specifically stated otherwise, thermodynamic simulation results of the present disclosure were obtained using the same database and software. As for a martensitic metastable phase, its region is predicted by selecting a FCC stable region because the martensitic metastable phase cannot be depicted in the equilibrium phase diagram, whereby a BCT-FCC dual phase alloy can be fabricated. To this end, the Cr element composition was limited to up to 11.87 wt. % in the present disclosure.

In addition, even though a large amount of chromium is added, the alloy can retain transformation induced plasticity (TRIP) because chromium is known to reduce a stacking fault energy in an FCC alloy.

Figure 4:
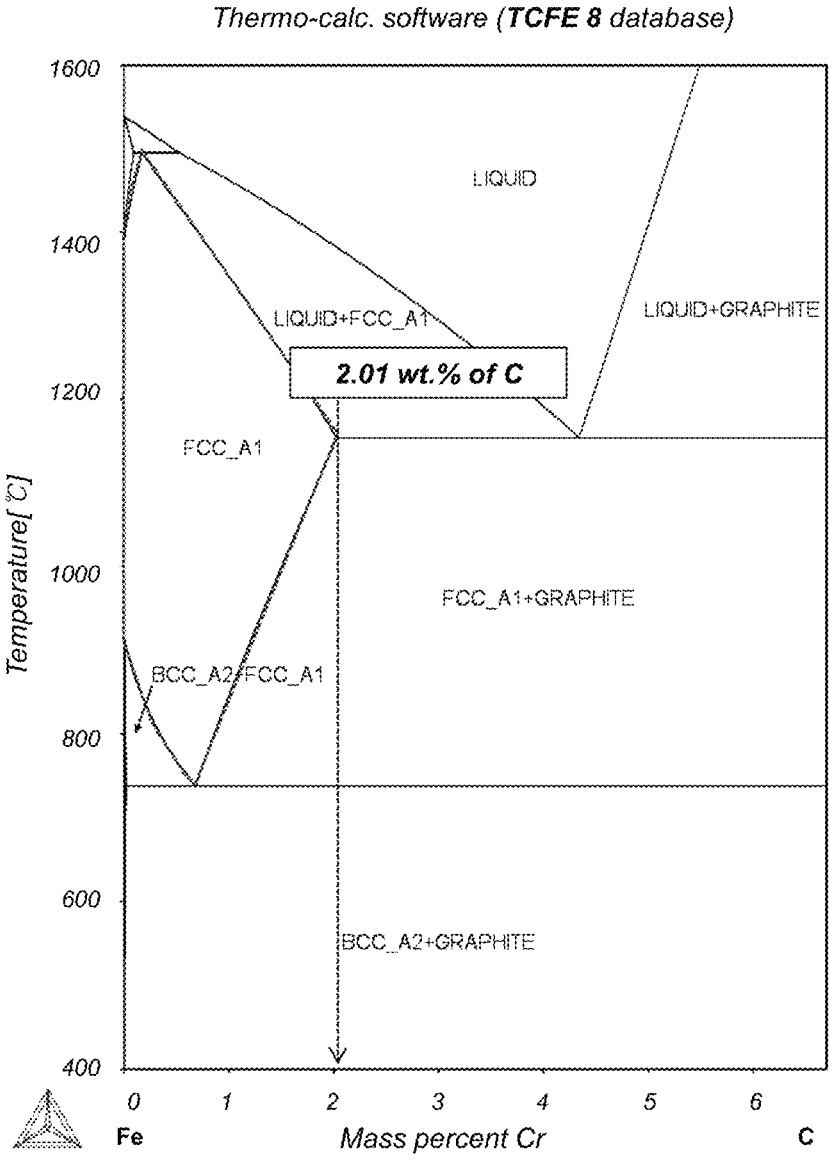
FIG. 4 is a Fe-C binary phase diagram showing maximum solubility of C soluble in face-centered cubic(FCC) Fe.

Since C is solid-solubilized in Fe to stabilize the body-centered cubic(BCC) structure at low temperatures, C can easily form a α' martensite phase upon quenching. In addition, C may be located at an interstitial site, stimulating martensitic transformation. Thus, the addition of carbon is essential for the fabrication of the resettable alloy of the present disclosure, with the maximum content thereof limited to 2.01 wt. %, which is the maximal solid solution limit in the γ phase as shown in the iron-carbon phase diagram of FIG. 4. In sum, the maximum of the alloy composition according to the present disclosure is as follows:

$Fe_{100-a-b-c}Mn_aCr_bC_c$ ($3 \le a \le 15$, $0 \le b \le 11.87$, and $0 \le c \le 2.01$ wt. %) (as for Mn, its limits are reasoned later)

Alloys of the present disclosure containing Mn and Cr in controlled amounts on the basis of the composition are given in Table 1, below. In this regard, raw materials with a purity of 99.99% or higher were prepared and alloyed using arc melting, which is a method capable of rapidly forming a bulk-type homogeneous solid solution, to afford the alloys according to embodiments of the present disclosure.

For the preparation of master alloys of the present disclosure, induction casting in which an electric field can be used to melt and alloy raw elements as well as arc melting can be employed. Alternatively, the preparation may be achieved by a typical casting process using resistance heating which is capable of fine temperature control. In addition to a typical casting process able to melt raw materials, powder metallurgy may be employed to make raw materials into powder which may then be sintered at high temperature/pressure using spark plasma sintering or hot isostatic pressing to afford the master alloys. These sintering methods are advantageous because they make it easy to more finely control the microstructures and to manufacture articles of desired shapes.

As seen in Table 1, all the materials of the present disclosure which were cast through arc melting were fabricated into composite structure alloys in which a BCC phase and a FCC phase, different from a martensite phase, were simultaneously formed because the phases were established according to the equilibrium phase diagram.

TABLE 1

| Alloy | Element Content (wt. %) Fe | Mn | Cr | C | Resetting treatment | Crystalline structure (Phase) |
|---|---|---|---|---|---|---|
| Alloy 1 | 96.9 | 0 | 3 | 0.1 | None | BCC + FCC |
| Alloy 2 | 87.9 | 9 | 3 | 0.1 | None | BCC + FCC |
| Alloy 3 | 81.9 | 15 | 3 | 0.1 | None | BCC + FCC |
| Alloy 4 | 90.9 | 0 | 9 | 0.1 | None | BCC + FCC |
| Alloy 5 | 81.9 | 9 | 9 | 0.1 | None | BCC + FCC |
| Alloy 6 | 75.9 | 15 | 9 | 0.1 | None | BCC + FCC |

For an enhancement effect, iron-based alloys may be supplemented with additional elements including vanadium (V, maximum solubility in Fe of 3 wt. %), niobium(Nb, maximum solubility in Fe of 3 wt. %), molybdenum(Mo, maximum solubility in Fe of 4 wt. %), tantalum(Ta, maximum solubility in Fe of 3 wt. %), and tungsten(W, maximum solubility in Fe of 3 wt. %).

In sum, at least one selected from the element group consisting of vanadium, niobium, molybdenum, tantalum, and tungsten may be added in an amount of up to 3 wt. %, based on the total weight of the alloy, in order to strengthen the alloy.

Even when alloy 5 in Table 1, having a representative composition, was added with 0.5-3 wt. % of one of the additive elements based on the total weight of the master alloy, the resulting alloys were found to have the same crystalline structures as the mater alloy, without forming precipitates or stable intermediate phases. These results are summarized in Table 2, below.

TABLE 2

| Alloy | Element Content (wt. %) Fe | Mn | Cr | C | Additive Element (relative to total weight of alloy) | Different Phase |
|---|---|---|---|---|---|---|
| Alloy 7 | 81.9 | 9 | 9 | 0.1 | V 3.0 wt. % | None |
| Alloy 8 | 81.9 | 9 | 9 | 0.1 | Mo 3.0 wt. % | None |
| Alloy 9 | 81.9 | 9 | 9 | 0.1 | Nb 3.0 wt. % | None |

TABLE 2-continued

| Alloy | Element Content (wt. %) Fe | Mn | Cr | C | Additive Element (relative to total weight of alloy) | Different Phase |
|---|---|---|---|---|---|---|
| Alloy 10 | 81.9 | 9 | 9 | 0.1 | Ta 3.0 wt. % | None |
| Alloy 11 | 81.9 | 9 | 9 | 0.1 | W 0.5 wt. % | None |
| Alloy 12 | 81.9 | 9 | 9 | 0.1 | W 1.0 wt. % | None |
| Alloy 13 | 81.9 | 9 | 9 | 0.1 | W 3.0 wt. % | None |

Figure 5:
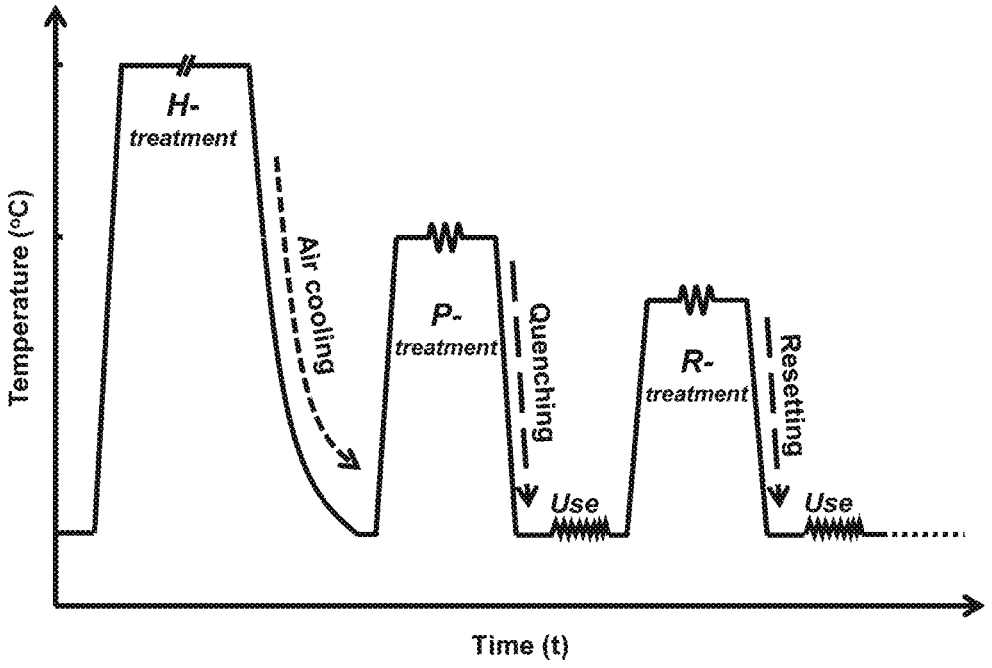
FIG. 5 is a schematic view showing two-step heat treatment processes(H-treatment and P-treatment) and resetting treatment(R-treatment) for manufacturing a resettable alloy according to the present disclosure.

Establishment of Two-Step Heat Treatment Process for BCT-FCC Dual Phase Formation FIG. 5 is a schematic view showing heat treatment processes for fabrication and use of resettable alloy according to the present disclosure. In order to exhibit resettability, the alloy should undergo finely designed two-step heat treatment processes as well as having an optimized alloy composition.

Of the two-step heat treatment processes for fabricating dual phase resettable alloy, the first is a H-treatment step for forming a full BCT phase across the alloy. In this step, homogenization treatment is conducted to make a full austenite phase, followed by air cooling to form a metastable BCT phase. For H-treatment, heat treatment is necessary at an austenite-stable region so that the entire alloy structure can form a martensite phase during the air cooling after being provided with a full austenite phase microstructure.

Figure 6:
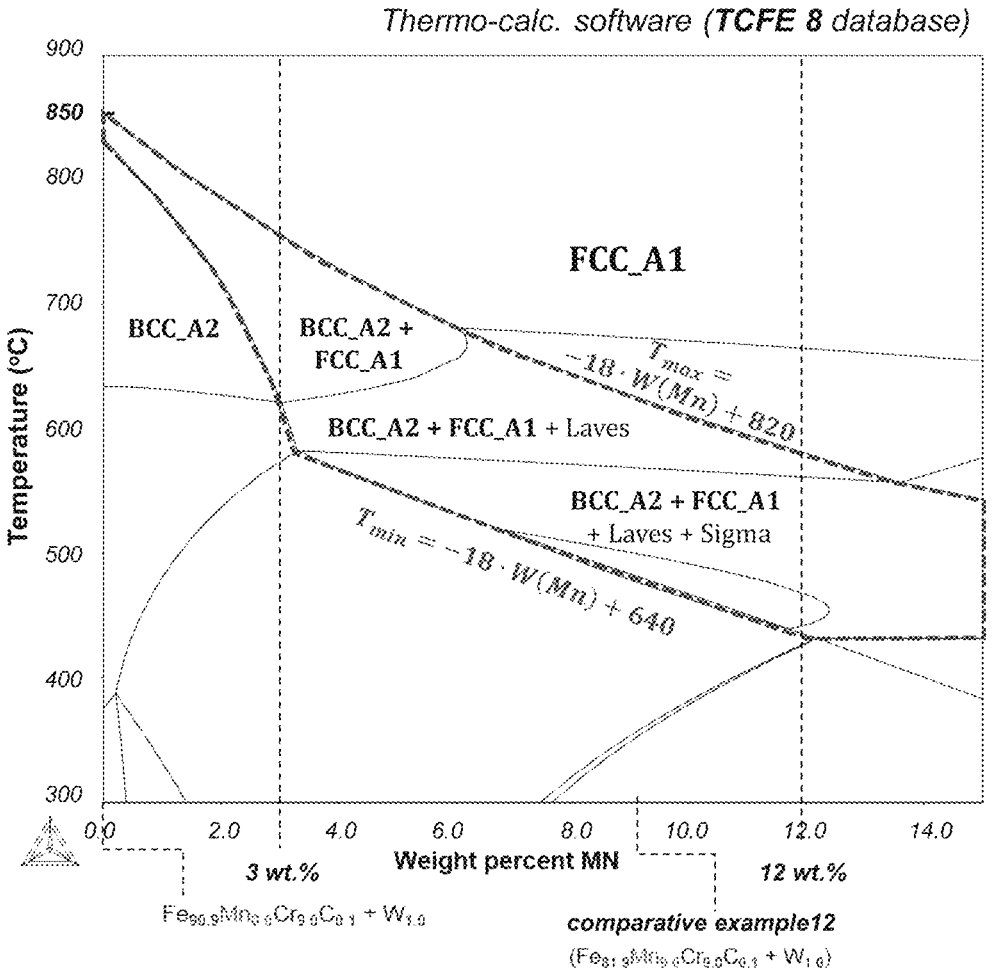
FIG. 6 is a pseudo-binary phase diagram constructed for alloy 14, with Mn substituted for Fe by weight percent.

FIG. 6 is a pseudo-binary phase diagram constructed for alloy 14 of Table 3 through thermodynamic simulations with Mn substituted for Fe within the amount of 0 to 15 wt. %. As shown in the drawing, the alloy has a full FCC austenite phase at about 850° C.

Thus, H-treatment(first heat treatment step) is particularly conducted at a temperature of 850° C. or higher and at a temperature of 1230° C., which corresponds to 80% of the melting point 1538° C. of the main alloy element iron, or lower. In addition, full homogenization can be achieved by even heat treatment at 850° C., which is more than 50% of the melting point of iron, for 0.5 hours or longer(conditions 7 and 8). In this regard, the terms "homogenization" refers to making the constituting elements fully homogeneous across the material. Once homogenization is achieved at a specific time point, the same state is continued. Thus, it is not meaningful to determine a maximum limit of homogenization time for a homogenized specimen. However, homogenization for 96 hours or longer is undesirable because it might precipitate an unpredicted additional phase, causing degradation. The retained austenite phase within the body-centered tetragonal (BCT) martensite phase matrix is maintained at a level of 50 vol. % or less after H-treatment.

Figure 7:
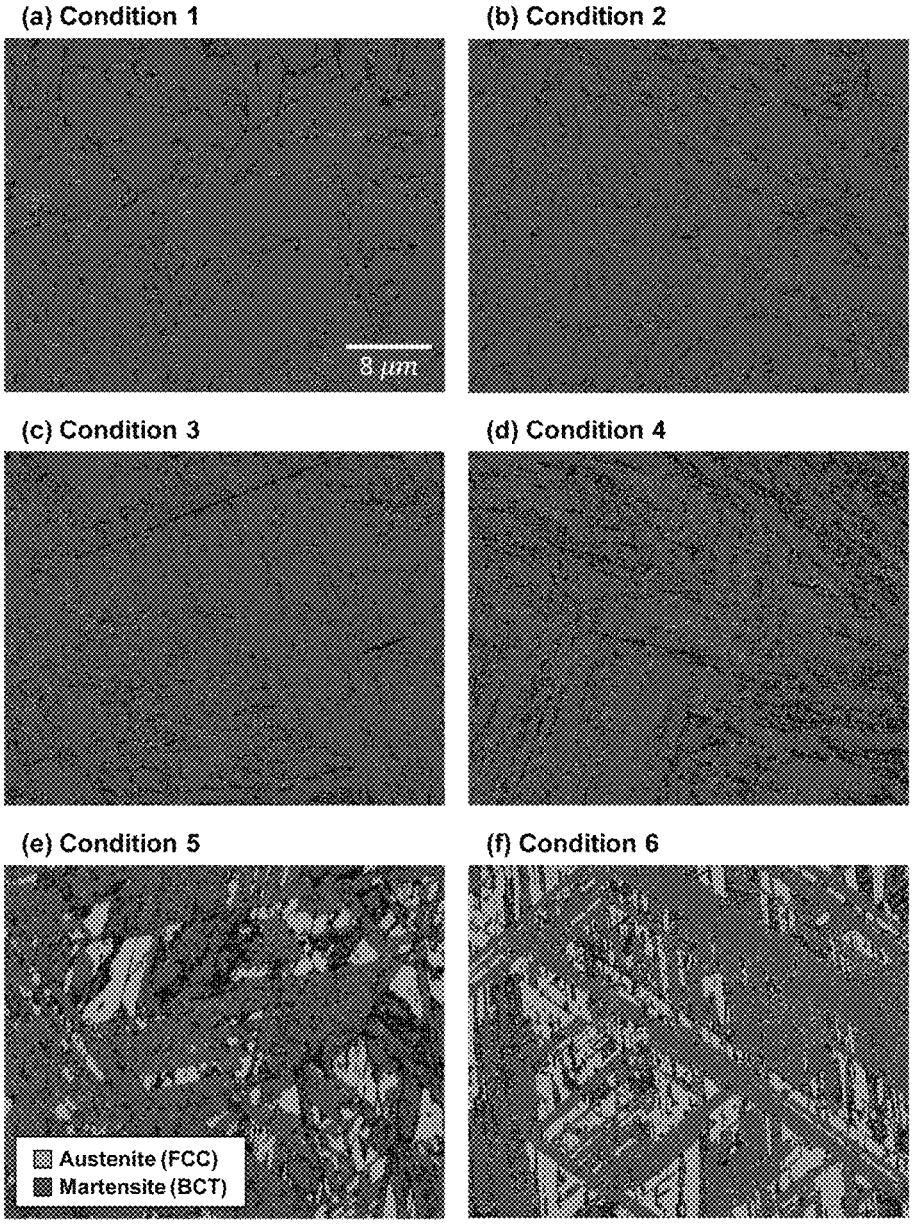
FIG. 7 shows Electron Back Scatter Diffraction(EBSD) microscopic images of the alloys constructed after the first step H-treatment of the two-step heat treatment of the present disclosure and air cooling.

FIG. 7 shows results of H-treatment conducted while the representative composition alloy 12 of the present disclosure varied in the amount of manganese from 0 to 15 wt. %(alloy 12 and alloys 14 to 18). Specific conditions are given as conditions 1 to 8 in Table 3.

TABLE 3

| Condition # | Alloy | Alloy Composition (wt. %) Fe | Mn | Cr | C | Additive Element (wt. %) W | H-treatment condition Temp. (° C.) | Time (hr) | Crystal structure (Phase) |
|---|---|---|---|---|---|---|---|---|---|
| 1 | Alloy 14 | 90.9 | 0 | 9 | 0.1 | 1 | 980 | 8 | BCT |
| 2 | Alloy 15 | 87.9 | 3 | 9 | 0.1 | 1 | 980 | 8 | BCT |
| 3 | Alloy 16 | 84.9 | 6 | 9 | 0.1 | 1 | 980 | 8 | BCT |
| 4 | Alloy 12* | 81.9 | 9 | 9 | 0.1 | 1 | 980 | 8 | BCT |
| 5 | Alloy 17 | 78.9 | 12 | 9 | 0.1 | 1 | 980 | 8 | BCT + FCC |
| 6 | Alloy 18 | 75.9 | 15 | 9 | 0.1 | 1 | 980 | 8 | BCT + FCC |
| 7 | Alloy 12* | 81.9 | 9 | 9 | 0.1 | 1 | 850 | 0.1 | BCT |
| 8 | Alloy 12* | 81.9 | 9 | 9 | 0.1 | 1 | 1200 | 0.1 | BCT |

As shown in the figure and table, when the resettable alloy according to the present disclosure underwent H-treatment, the FCC phase disappeared whereas the BCT martensite phase appeared.

The addition of manganese is known to induce a rapid increase of the austenite phase.

When manganese was added in an amount of 12 wt. % or greater as in conditions 5 and 6, the stability of the austenite phase was highly maintained such that the entire phase could not be stabilized into a martensite phase after the air cooling, with the resultant formation of retained austenite phase.

In this context, when the retained austenite is precipitated at a content of 50 vol. % or greater after the H-treatment, the austenite phase itself acts as a matrix to decrease the subgrain boundary, thus inhibiting the formation of martensite during P-treatment.

In order for the resettable alloy of the present disclosure to exhibit excellent properties, therefore, it is required that the retained austenite phase after H-treatment is present at a content of 50 vol. % or less. When this requirement is applied to the conditions of Table 3, Mn is preferably added in an amount of up to 15 wt. %.

P-treatment, which is the second heat treatment step for forming a metastable austenite phase at the grain boundary to the BCT phase through selective Mn segregation, is conducted at a lower temperature compared to the first step and thus requires input of a lower energy for the operation thereof. Accordingly, this step can be implemented even inputting various energies known to induce metastable phase transformation, including heat, electric, mechanical energies, and so on. However, the present disclosure will be explained mainly for heat energy input because the change pattern caused thereby is simple to identify.

For the selective segregation, a degree of energy input (e.g., input temperature) is very important. Particularly, such heat treatment must be conducted only in the region where BCC and FCC crystal structures coexist(two phase region) because the martensite phase thus formed does not easily disappear while nanoscale austenite phase is precipitated through rapid segregation of manganese in interphase boundary regions. The coexisting region of BCC and FCC phases in each composition is shown in FIG. 6. Referring to the pseudo-binary phase diagram, the coexisting region of BCC and FCC phases can be determined by a primary formula depending on contents of manganese and the maximum temperature Tmax and the minimum temperature Tmin can be represented as follows:

$$T\text{max}(^\circ\text{ C.})=-18\cdot\text{Wt }\%(\text{Mn})+820$$

$$T\text{min}(^\circ\text{ C.})=-18\cdot\text{Wt }\%(\text{Mn})+640$$

The second heat treatment P-treatment was applied to conditions 1 to 4 of Table 3 under which no retained austenite phases were formed after the first heat treatment and the results are summarized in Table 4.

P-treatment temperatures were calculated using the temperature fitting equations and the heat treatment was conducted at 650° C., which is the maximum temperature applicable to alloy 12. As shown in the figure, nanoscale FCC phases were precipitated by P-treatment in most of the compositions, with grains maintained in very small sizes.

TABLE 4

| | | P-treatment | | |
|---|---|---|---|---|
| Example No. | H-treatment | Temp. (° C.) | Time (hr) | Crystal Structure (Phase) |
| C. Example 1 | Condition 1 | 650 | 2 | BCT |
| Example 1 | Condition 2 | 650 | 2 | BCT + nano FCC precipitation |
| Example 2 | Condition 3 | 650 | 2 | BCT + nano FCC precipitation |
| Example 3 | Condition 4 | 650 | 2 | BCT + nano FCC precipitation |
| Example 4 | Condition 4 | 550 | 2 | BCT + nano FCC precipitation |
| Example 5 | Condition 4 | 500 | 2 | BCT + nano FCC precipitation |
| Example 6 | Condition 4 | 650 | 0.1 | BCT + nano FCC precipitation |
| Example 7 | Condition 4 | 500 | 0.1 | BCT + nano FCC precipitation |
| Example 8 | Condition 4 | 650 | 96 | BCT + nano FCC precipitation |
| Example 9 | Condition 4 | 500 | 192 | BCT + nano FCC precipitation |
| C. Example 2 | Condition 4 | 500 | 200 | BCT + FCC precipitation + additional low-temperature stable phase |

Figure 8:
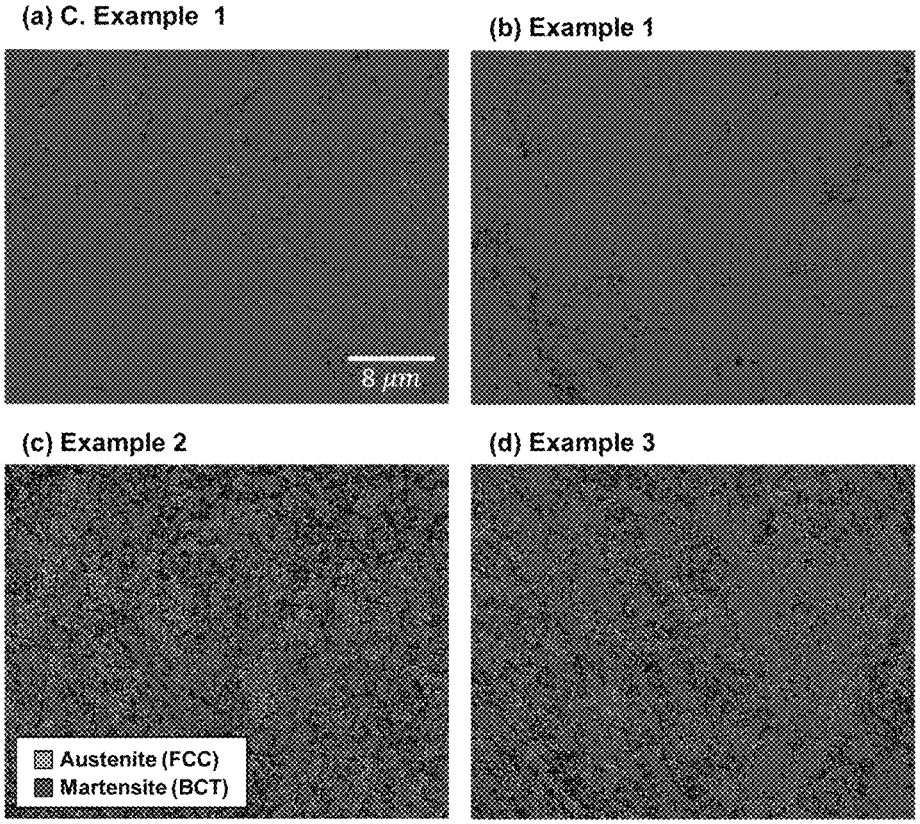
FIG. 8 shows EBSD microscopic images of the alloys constructed after the second step P-treatment of the two-step heat treatment of the present invention and quenching according to differences in Mn fraction.

For Comparative Example 1 in which manganese, which is apt to induce a segregation behavior, was not contained at all, only grain growth was achieved without stabilizing the austenite phase, as shown in FIG. 8.

In Example 1 where manganese was contained although in a small amount(3 wt. %), partial manganese segregation was observed to occur after selective segregation for 2 hours, with the concomitant formation of an austenite phase. Hence, a manganese content is preferably 3 wt. % or greater.

Furthermore, even when conditions of selective segregation temperatures and times were varied as in Examples 6 to 9, nanoscale austenite phases were easily precipitated. Particularly, when heat treatment was conducted in an austenite-stable region, grain growth rapidly progressed in view of the characteristics that the austenite phase grows at the subgrain boundary relatively high in energy. The treatment time for controlling the size is very important. In addition, the second heat treatment step is to induce reversible phase transformation between metastable FCC-metastable martensite phases by selective segregation of Mn at the subgrain boundary, which is a relatively high energy region compared to the first step. Hence, desired microstructures can be obtained within a treatment time of 0.1 hour, which is short compared to H-treatment.

However, it is undesired to conduct P-treatment for more than 192 hours(Comparative Example 2) because the precipitated austenite phase may grow to a size of 100 μm or larger or an undesirable low-temperature stable phase may be formed.

Recovery of Resettable Alloy to Initial Microstructure through R-Treatment

R-treatment is a process in which the structure that underwent stress-induced transformation from austenite phase to martensite phase is recovered to the initial martensite(BCT)-austenite(FCC) dual phase structure by deformation.

When the FCC-BCT dual phase resettable alloy fabricated above is strained, the soft FCC phase preferentially deforms because the strain is partitioned thereon. As a result, the austenite phase is changed into the same martensite phase as the matrix through stress-induced transformation. R-treatment recovers the transformed martensite phase back to the austenite phase, with the aim of reusing the alloy.

Although only a process of recovering microstructure through heat treatments is elucidated in detail here, the present disclosure may also utilize other energy input approaches similar in effect to heat treatments. Particularly, additional energy supply methods for controlling phase changes, including(direct or alternating) current application to induce electron transfer, lattice vibration, etc., and mechanical energy input are also possible.

Herein, conditions for R-treatment are similar to those for P-treatment, which is a process for reversion austenite phase in a martensite structure upon the fabrication of resettable alloy. However, phase resetting can be achieved even within a short time(1 minute or longer) compared to conventional P-treatment because selective segregation has already proceeded with the diffusion in the second heat treatment step. When conducted for a long time exceeding 192 hours, R-treatment causes the recovered phase to grow to a size of 100 μm or greater or the low-temperature stable phase to be precipitated, degrading the resettable alloy, like P-treatment.

Microstructures were obtained over various times of resetting treatment for the alloy of Example 3 and the results are summarized in Table 5, below. In view of the results of Examples 10 to 12, R-treatment is preferably conducted for 1 minute to 192 hours under the same condition as for P-treatment.

TABLE 5

| | | R-treatment | | |
|---|---|---|---|---|
| Example No. | Fabrication Condition | Temp. (° C.) | Aging Treatment (min) | Crystal Structure (Phase) |
| Example 10 | Example 3 | 650 | 1 | BCT + nano FCC precipitation |
| Example 11 | Example 3 | 650 | 120 | BCT + nano FCC precipitation |
| Example 12 | Example 3 | 650 | 5,760 | BCT + nano FCC precipitation |
| Example 13 | Example 3 | 650 | 11,520 | BCT + nano FCC precipitation |
| C. Example 3 | Example 3 | 650 | 12,000 | BCT + FCC precipitation + additional low-temperature stable phase |

Test for Resettability of Resettable Alloy through R-Treatment

The alloys of the present disclosure were examined for yield stress(YS), ultimate tensile stress(UTS), maximum elongation, and austenite phase fraction, with the ratio of manganese therein varying, and the results are given In Table 6. As is understood from the data of Table 6, the alloys of the present disclosure have mechanical properties of high strength and elongation satisfying the following properties: yield stress of 200 MPa or greater, UTS of 500 MPa or greater, and elongation of 10% or greater.

TABLE 6

| Alloy # | wt. % | YS (MPa) | UTS (MPa) | Max. El. (%) | γ Phase fraction (vol.) |
|---|---|---|---|---|---|
| Alloy 15 | 3 Mn | 402 | 560 | 32 | 4 |
| Alloy 16 | 6 Mn | 655 | 770 | 18 | 8 |
| Alloy 12* | 9 Mn | 633 | 1047 | 16 | 10 |
| Alloy 17 | 12 Mn | 315 | 1210 | 12 | 27 |
| Alloy 18 | 15 Mn | 218 | 975 | 30 | 35 |

Figure 9:
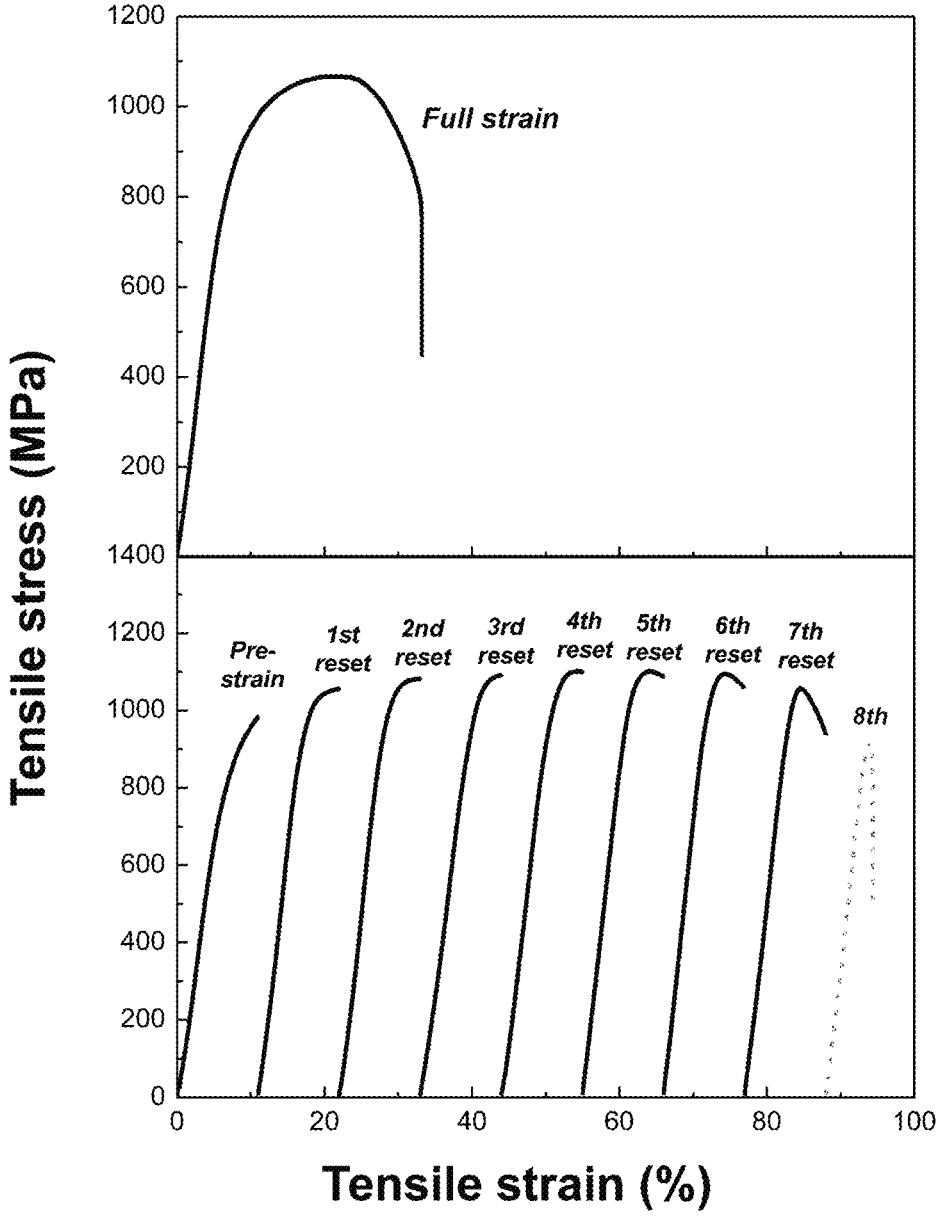
FIG. 9 shows stress-stain curves obtained after the resettable alloy of the present disclosure undergo many rounds of uniaxial tensile test and uniaxial tensile partial deformation-resetting.

FIG. 9 shows results obtained after repetition of partial deformation and then recovery at 650° C. for 2 hours, which are the same condition as for the aging treatment, on alloy 12 derived from the resettable alloy fabricated in the same condition as in Example 3. As can be seen in the figure, a maximum elongation of about 30% is achieved after a general uniaxial tensile test.

The critical point of deformation within which the resetting treatment is allowed to functionally act on the alloys of the present disclosure was observed to amount to 80% of the elongation at which an ultimate tensile stress(UTS) was obtained. On the basis of this feature, deformation was carried out to a degree of about 12%, which amounted to 40% of the maximum elongation, followed by resetting treatment. As shown in FIG. 9, the existing properties were fully recovered. In this test, a total of 7 recovery rounds was successfully conducted, with the elongation of up to about 90% obtained, whereby the alloy improved three-fold larger in elongation, compared to existing alloys while retaining a similar strength. Thus, it is understood that the resettable alloy developed in the present disclosure successfully recovered the initial BCT+FCC dual phase through the resetting treatment.

Taken together, the data obtained above indicate that the resettable alloys manufactured by applying the two-step heat treatment process to alloys exhibit improved mechanical properties and can be repetitively reused through additional resetting treatment.

The scope of the present invention should be interpreted by claims attached thereto, and it should be interpreted that all technical spirits within the scope equivalent to the claims pertains to the scope of the present invention.

What is claimed is:

1. A method for manufacturing a resettable alloy comprising body-centered tetragonal(BCT)-face-centered cubic (FCC) dual structure and having a composition $Fe_{100-a-b-c}Mn_aCr_bC_c$, wherein $3 \le a \le 15$, $0 < b \le 11.87$, and $0 < c \le 2.01$ wt. %, the body-centered tetragonal(BCT)-face-centered cubic (FCC) dual structure comprising:

BCT martensite phase matrix; and

FCC austenite phase present within the matrix, the method comprising the steps of:

preparing and melting alloy elements to which segregation engineering is applicable, to afford an alloy;

applying a two-step heat treatment to the alloy to form a BCT-FCC dual phase microstructure that is able to undergo metastable reversible phase transformation, wherein the two-step heat treatment comprises;

homogenization treatment (H-treatment) conducted at 850-1230° C., for 0.5 to less than 96 hours followed by air cooling as a first step; and preferential site segregation treatment (P-treatment) conducted for 0.1 to 192 hours followed by quenching as a second step; and optimizing resettability in the alloy through resetting treatment (R-treatment) conducted for 1 minute to 192 hours, wherein the P-treatment and the R-treatment are conducted at a following minimum temperature ($T_{min}$) to a following maximum temperature ($T_{max}$), $$T\max(^\circ\,C.) = -18 \cdot wt\,\%(Mn) + 820$$

$$T\min(^\circ\,C.) = -18 \cdot wt\,\%(Mn) + 640,$$

wherein the FCC austenite phase retained within the BCT martensite phase matrix is maintained at a level of 50 vol. % or less after the H-treatment.

2. The method of claim 1, wherein at least one selected from the group consisting of V, Nb, Mo, Ta, and W is further added in an amount of up to 3 wt. % based on a total weight of the alloy to improve strength in the alloy.

* * * * *